United States Patent [19]

Steinebrunner et al.

[11] 4,111,491

[45] Sep. 5, 1978

[54] METHOD AND APPARATUS FOR FEEDING BRISTLES IN BRUSH MAKING MACHINES

[75] Inventors: Walter Steinebrunner, Todtnau-Sonnhalde; Arthur Zahoransky, Freiburt i. Br.; Heinz Zahoransky, Todtnau, all of Fed. Rep. of Germany

[73] Assignee: Anton Zahoransky, Todtnau, Fed. Rep. of Germany

[21] Appl. No.: 799,707

[22] Filed: May 23, 1977

[30] Foreign Application Priority Data

Jul. 17, 1976 [DE] Fed. Rep. of Germany ..... 2632328

[51] Int. Cl.[2] ..... A46D 1/04

[52] U.S. Cl. ..... 300/21; 300/7

[58] Field of Search ..... 300/2, 4, 5, 7, 21; 221/31, 227, 232, 239; 214/301, 302, 305

[56] References Cited

U.S. PATENT DOCUMENTS

| | | | |
|---|---|---|---|
| 2,356,121 | 8/1944 | Cave et al. | 300/7 |
| 3,367,719 | 2/1968 | Carlson | 300/7 |
| 3,556,602 | 1/1971 | Gardner et al. | 300/7 |

*Primary Examiner*—Granville Y. Custer, Jr.

*Attorney, Agent, or Firm*—Peter K. Kontler

[57] ABSTRACT

The outlet of a magazine for a supply of parallel bristles in a bursh making machine is adjacent to an oscillatable element which transfers compacted tufts of bristles to an inserting tool. The supply of bristles in the magazine is compacted by one or more reciprocable tamping members which compact the bristles during movement toward the outlet. Fresh bristles can be admitted in unconfined condition or in the form of bundles containing batches of parallel bristles confined in tubular envelopes. The envelopes are opened and removed not later than in the magazine and the released bristles are immediately compacted by one of the tamping members which urges the bristles against the other tamping member which continues to compress the remnant of the supply. The other tamping member is withdrawn and moved backwards prior to reintroduction into the magazine above the freshly admitted batch. The tamping members can bypass each other in the magazine. If the bundles form a chain, the foremost bundle whose envelope is still intact applies pressure against the trailing end of the column of bristles in the magazine to urge the leader of the column against the transfer element.

38 Claims, 22 Drawing Figures

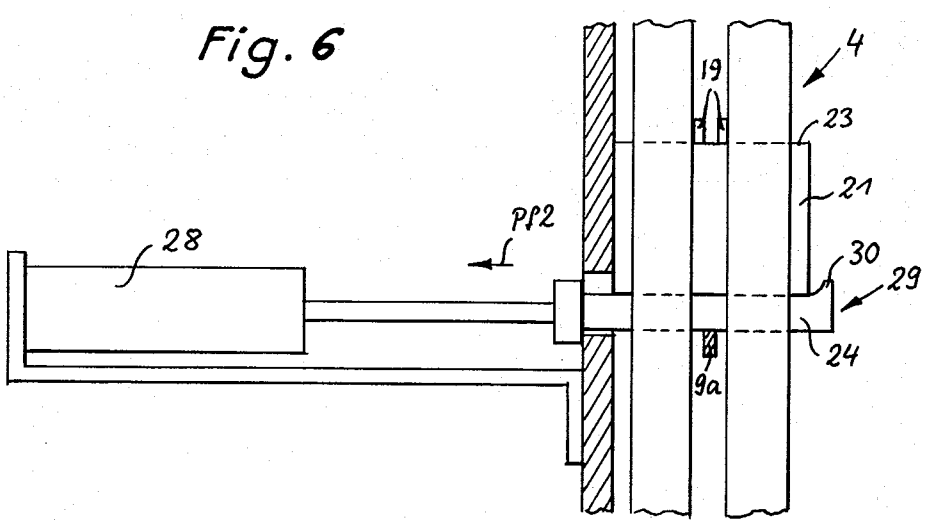
Fig. 6
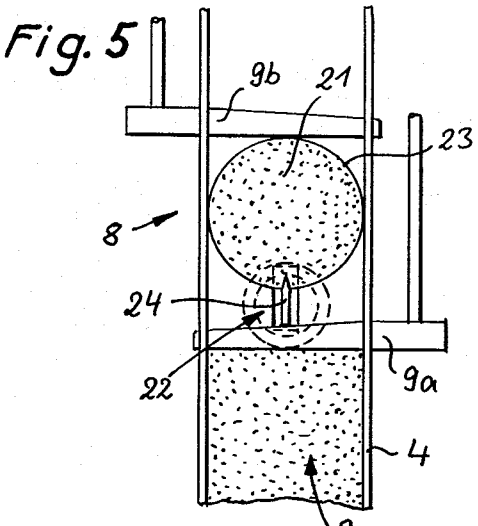
Fig. 5
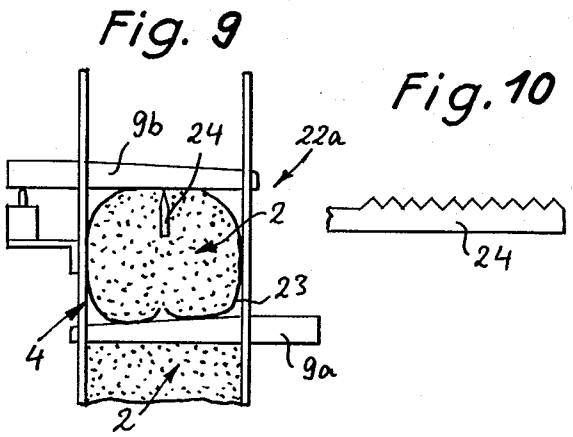
Fig. 9
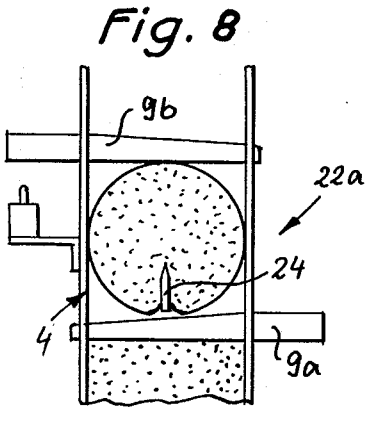
Fig. 8
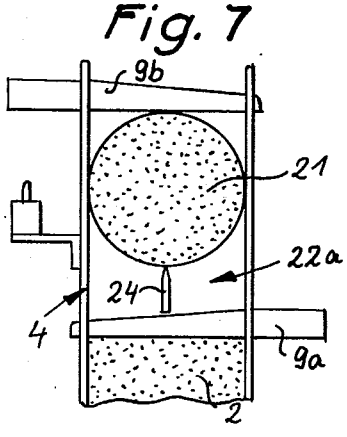
Fig. 7
Fig. 10

41A
P/3
42
41
41B
21
20'
23
21
9b
24
25'
9a
2
4
5

METHOD AND APPARATUS FOR FEEDING BRISTLES IN BRUSH MAKING MACHINES

BACKGROUND OF THE INVENTION

The present invention relates to the manufacture of brushes in general, and more particularly to improvements in a method and apparatus for feeding bristles to the station at which groups of tufts of bristles are inserted into the body of a brush.

It is known to apply pressure to the supply or stack of bristles from which a transfer element removes tufts for delivery to the inserting tool or tools. In accordance with a presently known proposal, a weight is placed on top of the stack of bristles is an upright magazine so that the lowermost layer of bristles in the magazine bears against the transfer element. The weight (e.g., a metallic body weighing between 2 and 5 kg) is manipulated by the attendant. Repeated lifting of the weight is tiresome to the attendant, especially to a female employee. Moreover, the admission of a fresh supply of bristles into the magazine requires a substantial amount of skill because, while the weight is lifted, the attendant must insert a fresh batch of bristles and must simultaneously apply manual pressure against the remainder of the stack in order to insure that the remnant of the preceding stack will descend into the range of the transfer element. Such manipulation of the bristle feeding apparatus is likely to result in injury to the hands of a semiskilled, unskilled or careless attandant, i.e., the hand which applies pressure against the top of the stack in the magazine is likely to advance into the range of the rapidly moving transfer element. Still further, even a highly skilled person is unable to insure continuous application of substantially unchanged pressure during refilling of the magazine.

It was also proposed to replace the weight with semi-automatic pressure applying mechanisms, particularly with pneumatic cylinder and piston units. Such mechanisms insure the application of uniform pressure to the supply of bristles in the magazine; however, they must be deactivated prior to admission of a fresh supply of bristles which are introduced into the magazine in the same way as described above.

OBJECTS AND SUMMARY OF THE INVENTION

An object of the invention is to provide a novel and improved method of establishing and maintaining an adequate supply of bristles in a brush making machine in such a way that the replenishment of the supply does not involve any danger to the attendants and that the replenishment can be carried out without any or with negligible changes in the magnitude of pressure with with the leading end of the supply is urged toward and into the range of tuft transferring instrumentalities.

Another object of the invention is to provide a fully automatic method of the just outlined character which guarantees the establishment and maintenance of an adequate supply of bristles in relatively slow as well as in high-speed brush making machines.

A further object of the invention is to provide a method which can be practiced by resorting to relatively simple, compact and reliable apparatus.

An additional object of the invention is to provide a method which insures the application of constant pressure against the supply of bristles regardless of the quantity of bristles in the magazine.

A further object of the invention is to provide a novel and improved apparatus which can be utilized for the practice of the above outlined method, which requires a minimum of attention, which can be installed in existing brush making machines as a superior substitute for conventional bristle feeding apparatus, and which can be serviced by semiskilled or unskilled attendants.

An ancillary object of the invention is to provide the apparatus with novel and improved means for applying constant pressure to the supply of bristles regardless of the extent to which the magazine is filled.

Still another object of the invention is to provide an apparatus which can process unconfined or confined (packaged) batches of bristles.

One feature of the invention resides in the provision of a method of feeding tufts of bristles to the inserting station of a brush making machine where the tufts are embedded in or otherwise affixed to the body of a brush. The method comprises the steps of establishing and maintaining a supply of substantially parallel bristles at or close to the inserting station (such supply can be established and maintained in a vertical, horizontal or otherwise inclined magazine or duct at least one end of which is open to allow for removal of tufts from the leader of the supply of bristles therein), subjecting the bristles of the supply to the action of a first compacting force (preferably by mechanically biasing the bristles of the supply), removing tufts of bristles from the compacted supply, and intermittently merging additional bristles into the diminishing supply while continuing to subject the bristles of the diminishing supply to the action of the first force. The merging step includes subjecting the additional bristles (which may consist of loose bristles or of batches of bristles confined in suitable envelopes or wrappers) to the action of a second compacting force (preferably by mechanically biasing the additional bristles) which preferably at least approximates the first force so that the compactness of the thus replenished supply remains at least substantially unchanged.

If the bristles are confined in envelopes (e.g., in tubes consisting of synthetic plastic material or helically convoluted paper strips), the method further comprises the steps of transporting successive batches of bristles to the supply and removing the envelopes from successive batches not later than in the course of the merging step. The envelope-removing step is preferably preceded by the step of opening the envelopes (e.g., by resorting to a knife). When the diminishing supply of bristles is replenished by merging therewith batches of bristles which are fed to the supply in envelopes, the steps of subjecting the supply of bristles and the batches to the action of compacting forces may include pressing confined batches against the bristles of the supply.

In order to further reduce the likelihood of unsatisfactory compacting of bristles during removal of tufts from the supply, the method may further comprise the steps of monitoring the number of removed tufts and initiating the merging step in automatic response to removal of a predetermined number of tufts (such number preferably equals the number of tufts which are needed for the making of a brush so that the replenishment of the supply of compacted bristles can take place simultaneously with replacement of a finished brush by a fresh brush body).

If the supply of compacted bristles forms an upright or substantially upright column, the tufts are preferably removed from the bottom of the column and the additional bristles are fed on top of the diminishing supply. If the supply is confined in a horizontal or nearly horizontal path, the removing step includes removing tufts from the leading end and the merging step further includes feeding additional bristles to the trailing end of the supply.

The batches can be connected to each other (e.g., by a flexible web) to form a chain of successive bundles or batches (such chain can be coiled into a roll), and the merging step then further includes (or may include) feeding successive batches of the chain to the diminishing supply. The chain can be fed by a sprocket wheel or by an analogous rotary advancing device whose teeth enter successive perforations of one or more rows of perforations in the aforementioned web.

The step of removing (preferably opened) envelopes may include mechanically grasping the envelopes by needles or other types of projections, grasping the envelopes by jaws or grippers, grasping the envelopes by other mechanical removing devices, causing the envelopes to adhere to one or more suction cups and/or causing the envelopes to adhere to one or more adhesive-coated pads or strips.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 5 is an enlarged end elevational view of an envelope opening device which can be used in the apparatus of FIG. 4;

FIG. 6 is a view as seen from the left-hand side of FIG. 5;

FIG. 7 is an end elevational view of a modified envelope opening device;

FIG. 8 illustrates the structure of FIG. 7 with a batch of bristles immediately after severing of the envelope;

FIG. 9 illustrates the structure of FIG. 7 with the parts which bias the bristles in different positions;

FIG. 10 is a schematic side elevational view of a knife which can be utilized in the opening device of FIGS. 7 to 9;

DESCRIPTION OF THE PREFERRED EMBODIMENTS

Figure 1:
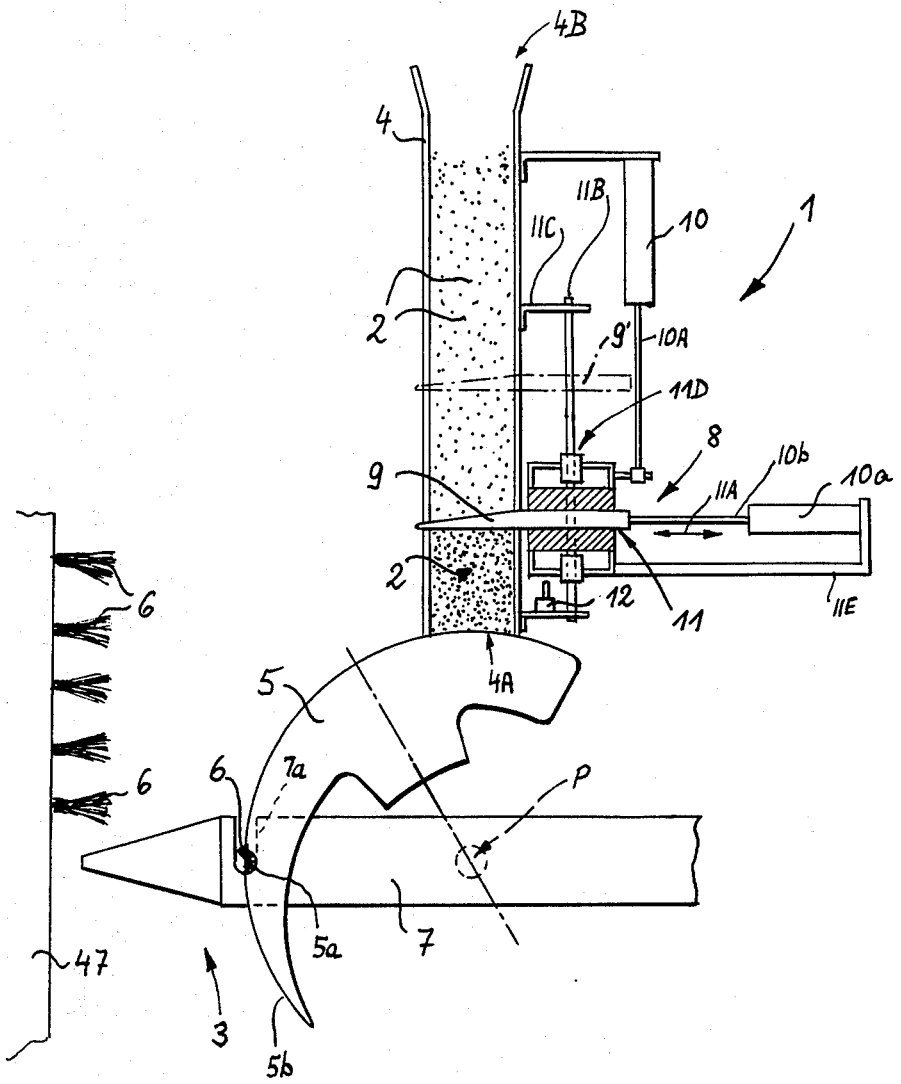
FIG. 1 is a fragmentary partly elevational and partly sectional view of a brush making machine including a bristle feeding apparatus which embodies one for of the invention.

Referring first to FIG. 1, there is shown an apparatus 1 which serves to maintain an adequate supply of condensed bristles 2 for transfer to an inserting tool 7 at a station 3 at which the tool introduces tufts 6 of bristles into the body 47 of a brush. The apparatus 1 comprises an upright magazine 4 which contains a supply or stack of bristles 2 and the open lower end or outlet 4A of which is adjacent the path of an oscillating transfer element 5 fulcrumed at P and having a suitably configurated recess **5*a* in a convex surface 5*b* which closes the lower end of the magazine 4. The recess 5*a* receives a tuft 6 of bristles 2 during movement below the lower end of the magazine 4, and the freshly accumulated tuft 6 is thereupon transferred into a slot 7*a* of the tool 7 for insertion into the brush body 47** in a manner not forming part of the invention.

Figure 3:
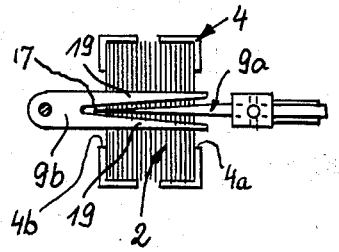
FIG. 3 is a transverse horizontal sectional view as seen in the direction of arrows from the line III—III of FIG. 2.

In order to insure reproducible accumulation of bristles 2 in the recess **5*a*, the supply of bristles 2 immediately above the convex surface 5*b* of the transfer element 5 must be maintained at a constant pressure or at a pressure which fluctuates within a narrow range. The pressure applying unit 8 of the apparatus 1 includes a biasing or tamping member 9 which extends transversely across the interior of the magazine 4, i.e., transversely of the bristles 2 in the magazine. To this end, the walls of the magazine 4 are formed with vertical slots 4*a*, 4*b* which are shown in FIG. 3. The pressure applying unit 8 further comprises two motors 10 and 10*a* each of which may constitute a double-acting pneumatic or hydraulic cylinder and piston unit. The motor 10 has a vertical piston rod 10A which is connected to a frame 11 wherein the biasing member 9 is reciprocable in the direction indicated by arrow 11A. The frame 11 is movable up and down along one or more guide rods 11B which are mounted in brackets 11C supported by the magazine 4. The bearings which form part of the frame 11 and slidably surround the illustrated guide rod 11B are shown at 11D. A bracket 11E of the frame 11 carries the motor 10*a* whose piston rod 10*b* is directly coupled to the biasing member 9. The reference character 12 denotes a limit switch which is mounted on the magazine 4 in the path of downward movement of the frame 11 and controls the system of valves (not shown) for the motors 10 and 10*a* in such a way that the piston rod 10A moves upwardly when the switch 12 is actuated, i.e., when the supply of bristles 2 in the magazine 4 is nearly depleted. Upward movement of the biasing member 9** to the phantom-line position 9′ is preceded by a retraction from the magazine 4 through the medium of the piston rod 10*b*. In other words, each actuation of the switch 12 results in a cyclical movement of the biasing member 9 including a horizontal movement in a direction to the right, as viewed in FIG. 1, thereupon an upward movement away from the inlet 4A (such movement is shared by the motor 10*a*), then a leftward movement to the position 9′, and finally a movement toward the outlet 4A whereby the member 9 compacts the bristles 2 between its underside and the outlet 4A and urges the bristles toward the outlet. A fresh supply of bristles 2 is introduced behind the previously compacted bristles during the interval when the biasing member 9 is retracted from the magazine 4.

The upper chamber of the motor 10 normally receives pressurized fluid to urge the biasing member 9 against the upper side of the freshly introduced supply. Since the freshly admitted bristles invariably or often form a rather loose batch, the biasing member 9 can be introduced into the magazine 4 (in the position 9′) below the upper surface of the freshly admitted batch, i.e., the member 9 can penetrate through the loose material in the upper portion of the magazine during leftward movement toward the position 9′.

In order to insure that temporary retraction of the biasing member 9 from the magazine 4 does not affect the accumulation of tufts 6 and hence the quality of a brush at the inserting station 3, the admission of a fresh supply of bristles 2 into the magazine 4 by way of the open upper end or inlet 4B preferably coincides with replacement of a completed brush with a fresh brush body 47. For example, if the removal of a completed brush and the admission of a fresh brush body 47 to the station 3 take up an interval of 3 to 4 seconds, such interval is amply sufficient to allow for admission of a fresh supply of bristles 2 into the magazine 4. It is clear that the switch 12 constitutes but one of a variety of monitoring or detector means which can be employed to furnish a signal for retraction of the biasing member 9 preparatory to admission of a fresh supply of bristles. For example, the switch 12 can be replaced with a photoelectric cell. The arrangement is preferably such that the signnal which is furnished by the switch 12 is delayed until after the insertion of the last tuft 6 into a brush body 47 at the station 3, whereupon the piston rod 10*b* retracts the biasing member 9 from the magazine 4. Such delay is normally rather short, and the switch 12 can be mounted at a level which is high enough to insure that the remnant of the supply of bristles 2 in the magazine 4 suffices to allow for the completion of that brush whose body 47 is in the process of receiving tufts 6 at the station 3. The apparatus may employ a counter which furnishes a signal whenever the element 5 and/or tool 7 completes a predetermined number of working strokes (such number equals the number of tufts in a completed brush). When the counter furnishes a signal while the switch 12 is actuated by the frame 11, the motor 10*a* is caused to retract the biasing member 9 from the magazine 4 preparatory to introduction of a fresh supply of bristles 2 and movement of the member 9 to the position 9′.

The apparatus 1 of FIG. 1 can be used with advantage in an intermittently operated brush making machine. If the admission of fresh batches of bristles 2 into the magazine 4 is performed by hand, the dimensions of the magazine 4 can be readily selected in such a way that a single attendant can service several machines. Since the refilling of magazine 4 need not be carried out at exactly determined intervals, the attendant need not rush to a particular magazine when the supply of bristles therein is nearly exhausted. The switch 12 can be connected with a suitable device (e.g., a horn or a lamp) which furnishes visible and/or audible signals so that the attendant is informed of the impending need for replenishment of the supply of bristles.

It the magazine 4 is to be refilled by hand, it is preferably vertical or substantially vertical because this facilitates the admission of fresh batches of bristles.

Figure 2:
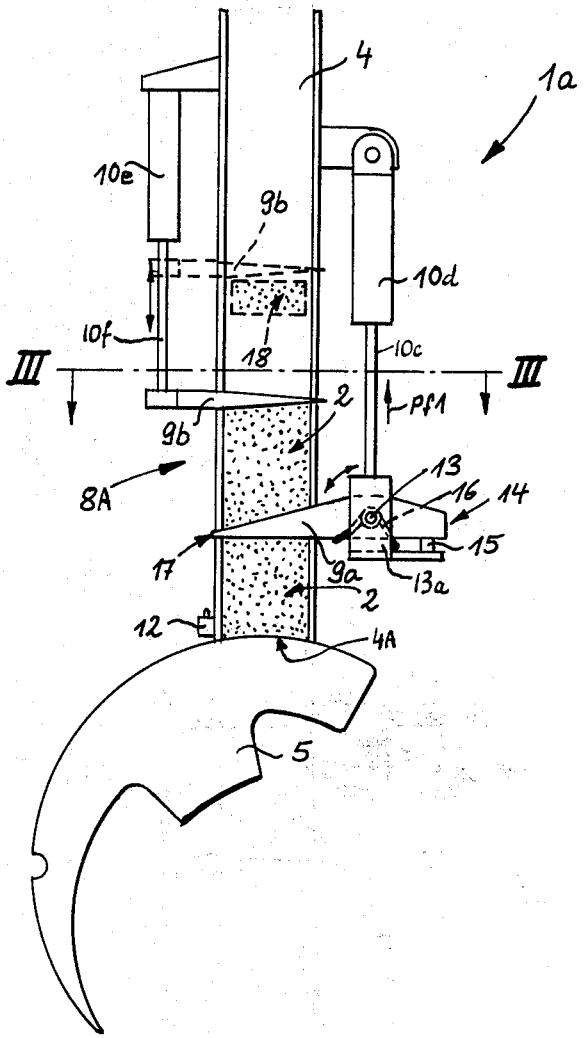
FIG. 2 is a similar view of a brush making machine which embodies a second bristle feeding apparatus.

FIG. 2 shows a modified apparatus 1*a* which is designed to maintain the bristles 2 immediately above the transfer element 5 at a constant pressure, not only when the magazine 4 contains an adequate supply of bristles but also during introduction of a fresh batch. The apparatus 1*a* can satisfy the requirements of a machine wherein a fresh brush body is ready for reception of tufts as soon as the insertion of the last tuft into the preceding brush body is completed. The pressure applying unit 8A of the apparatus 1*a* comprises two biasing or tamping members 9*a* and 9*b*. As shown in FIG. 3, the biasing member 9*a* has a tapering portion 17 which registers with and can move through the slot or gap between the bristle-engaging portions or prongs 19 of the bifurcated biasing member 9*b*. It will be seen that the portions 17 and 19 are offset with respect to each other so that the portion 17 can bypass the portions 19 and vice versa, depending upon whether the portion 17 biases the bristles 2 toward the outlet 4A while the portions 19 move away from the outlet or the other way around. It is further clear that the portions 17 and 19 can simultaneously urge the bristles against the transfer element 5.

The biasing member 9*a* is movable up and down by the piston rod 10*c* of a first fluid-operated motor 10*d* whose cylinder is articulately connected to the magazine 4. The lower end portion of the piston rod 10*c* carries a holder 13*a* for a horizontal pivot pin 13. The biasing member 9*a* is a two-armed lever the left-hand portion or arm 17 of which normally extends across the interior of the magazine 4 to engage the bristles 2 and the right-hand portion or arm 14 of which normally abuts against a stop 15 on the holder 13*a*. The member 9*a* is pivotable on the pin 13 and is biased against the stop 15 by a torsion spring 16. The limit switch 12 is located in the path of downward movement of the tip of the arm 17 of the biasing member 9*a*.

The biasing member 9*b* is attached to the piston rod 10*f* of a second fluid-operated motor 10*e* which is supported by the magazine 4. The reference character 18 denotes an inlet opening for admission of fresh batches of bristles 2 into the upper portion of the magazine 4. The piston rod 10*f* can lift the biasing member 9*b* to a level above the inlet opening 18 (see the phantom-line position 9*b*′ of the member 9*b*).

When the piston rod 10*c* moves upwardly and the biasing member 9*b* is located at a level above the biasing member 9*a* (i.e., when the major part of the arm 17 is buried in a compacted supply of bristles 2 in the lower portion of the magazine 4), the member 9*a* is caused to pivot anticlockwise, as viewed in FIG. 2, and to retract its arm 17 from the interior of the magazine. The spring 16 returns the member 9*a* to a substantially horizontal position of abutment with the stop 15 as soon as the tip of the arm 17 rises above the bristles which are engaged by the biasing member 9*b*. The signal which triggers the upward movement of piston rod 10c (see the arrow P*f*1) is furnished by the switch 12.

The operation of the apparatus 1a is as follows:

When the biasing member 9a reaches and actuates the switch 12, the piston rod 10c begins to move upwardly with resulting counterclockwise pivoting of the member 9a. The compacting action is then furnished by the descending biasing member 9b so that the pressure upon the supply of bristles 2 directly above the transfer element 5 remains unchanged or practically unchanged. It will be recalled that the wedge-like arm 17 of the member 9a registers with the gap between the prongs 19 of the member 9b so that the arm 17 can be retracted from the interior of the magazine 4 in each and every position of the member 9b. The tip of the arm 17 is preferably rounded so that it meets less resistance during travel along the right-hand side of the supply of bristles 2 in the magazine while the piston rod 10c advances in the direction indicated by arrow P*f*1. As mentioned above, the spring 16 returns the biasing member 9a into abutment with the stop 15 when the tip of the arm 17 moves above the biasing member 9b, i.e., the arm 17 reenters the magazine 4 whereby the direction of movement of the piston rod 10c is reversed so that the arm 17 bears against the top layer of bristles 2 in the magazine. In other words, the compacting action is taken over by the member 9a and the member 9b is free to rise to the position 9b' at a level above the inlet opening 18. The bristles 2 which are fed into the magazine 4 via opening 18 can be admitted by hand or by an automatic mechanism, not shown. The member 9b begins to descend after an interval of time which suffices for admission of a requisite supply of bristles 2 via opening 18 whereby the member 9b bears against the top of the freshly admitted supply and exerts pressure against the bristles above the member 9a. The member 9a continues to compact the bristles therebelow until its arm 17 reaches and actuates the switch 12. The cycle is then repeated in the aforedescribed sequence. It will be seen that the members 9a and 9b cooperate to compact the contents of the magazine 4, either singly or simultaneously, so that the supply of bristles 2 immediately above the convex surface of the transfer element 5 is subjected to a continuous and practically uniform compacting action.

The exact nature of controls (including the switch 12) which determine the sequence of movement of biasing members 9a and 9b forms no part of the invention. The switch 12 can form part of a follow-up control system or of a programming device of any known design.

The biasing member 9a can be provided with an arm which replaces the arm 17 and has several prongs which alternate with the prongs of the biasing member 9b.

Figure 4:
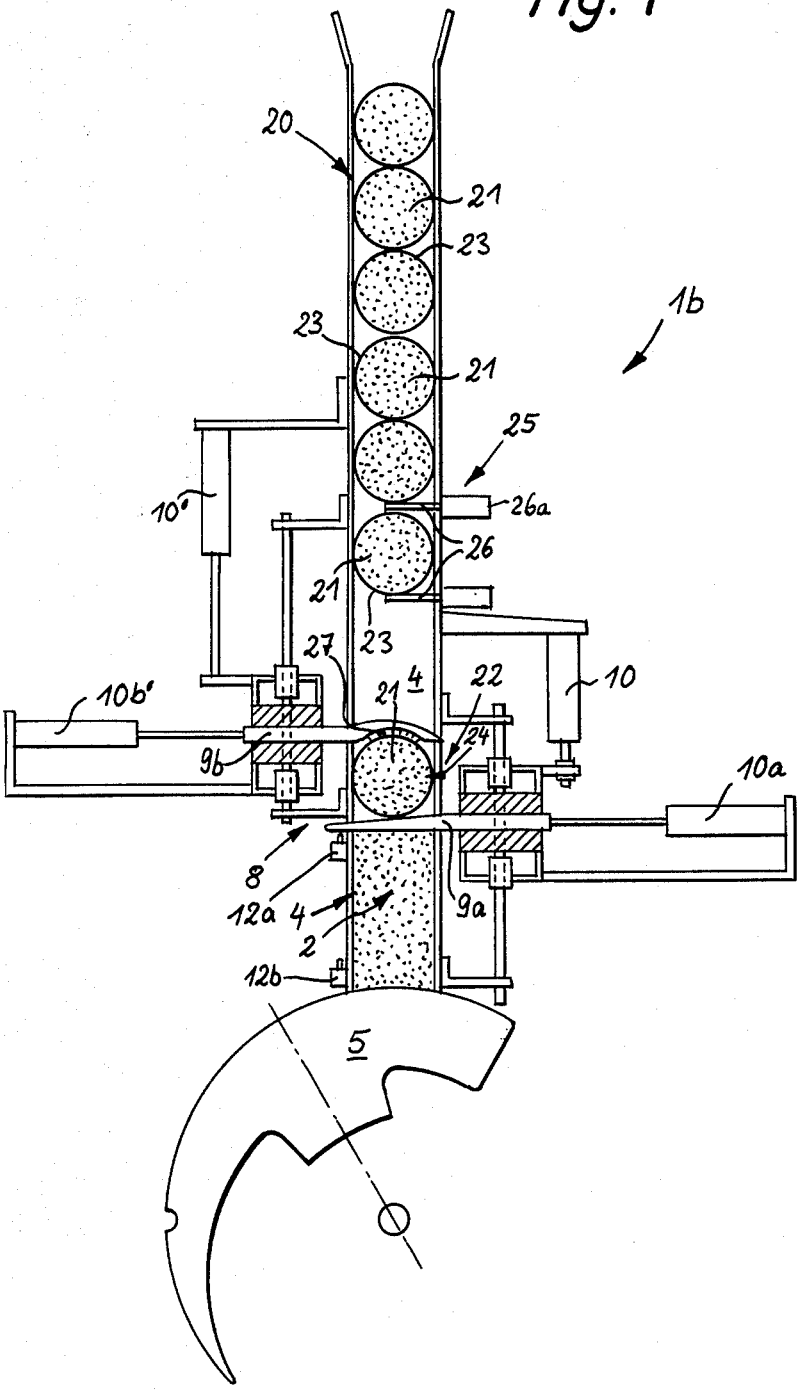
FIG. 4 is a fragmentary partly elevational and partly vertical sectional view of a brush making machine which embodies a third bristle feeding apparatus.

FIG. 4 illustrates an apparatus 1b which embodies certain features of the apparatus 1 and 1a and is further provided with means for accepting and processing (opening) packaged bundles 21 of bristles 2. The wrappers or envelopes 23 for the bundles 21 may consist of tubular synthetic plastic material or of helically convoluted paper strips which form tubes around cylindrical bundles 21.

In the apparatus 1b, the magazine 4 for unpackaged bristles 2 is located downstream (below) an upright second magazine or hopper 20 for a column of bundles 21. The envelope 23 of the lowermost bundle 21 is opened at a station 22 which includes means for supporting and moving a knife 24 or analogous means for severing the envelope 23. The envelope 23 is severed or otherwise opened and removed in the space between the tamping or biasing members 9a and 9b of the pressure applying unit 8. In the embodiment of FIG. 4, the envelope 23 is severed by slitting it open in the axial direction of the respective bundle 21. The severing station 22 is located immediately above the unit 8. The biasing member 9a is mounted and operated substantially in the same way as described for the member 9 of FIG. 1, except that the limit switch 12 is replaced with two limit switches 12a, 12b both located in the path of movement of the tip of the member 9a.

The severing station 22 is preceded by a singularizing unit 25 which serves to temporarily hold the lowermost bundle 21 of the stack in the hopper 20 and to permit the lowermost bundle to descend into the range of the knife 24 (which is installed in the magazine 4) when the supply of bristles 2 in the magazine is depleted to a predetermined extent. The singularizing unit 25 comprises two reciprocable gates 26 which can be actuated by fluid-operated cylinder and piston units 26a. The upper gate 26 is retracted from the hopper 20 when the lower gate 26 assumes the extended position of FIG. 4. This causes the lowermost bundle 21 to descend onto the lower gate. The upper gate is then returned to the extended position of FIG. 4 and enters between the two lowermost bundles to hold the next-to-the-lowermost bundle against downward movement. When the need arises, the lower gate 26 is retracted and permits the lowermost bundle 21 to enter the opening station 22.

The motors which transmit motion to the biasing member 9b are denoted by the reference characters 10' and 10b'. The reference character 27 denotes needles or analogous means for removing or evacuating opened envelopes 23 from the station 22.

The operation of the apparatus 1b is as follows:

It is assumed that the parts of this apparatus are in the positions shown in FIG. 4. The envelope 23 of the bundle 21 at the opening station 22 is severed by the knife 24 which, to this end, is moved at right angles to the plane of FIG. 4. The needles 27 of the biasing member 9b engage the opened envelope 23 and withdraw it from the station 22 in response to actuation of the motor 10b' which moves the member 9b in a direction to the left. If desired or necessary, the leftward movement of biasing member 9b (while the opened envelope 23 is held by the needles 27) can be preceded by an upward movement of the member 9b in response to actuation of the motor 10'. The contents of the opened envelope 23 are thereby dumped into the magazine 4 on top of the biasing member 9a which is urged in a downward direction by the motor 10. The expulsion or evacuation of an opened envelope 23 from the space below the lower gate 26 can be assisted or effected by one or more jets of compressed air which are discharged by suitably distributed and oriented nozzles (not shown) mounted in the apparatus at a level below the singularizing unit 25.

The operation of the pressure applying unit 8 depends on the nature of the brush making machine which receives tufts from the transfer element 5, i.e., whether the machine operates continuously or intermittently. If the inserting station is to receive tufts at regular intervals (i.e., if a fresh brush body is ready at the inserting station not later than upon insertion of the last tuft into the preceding brush body), the biasing member 9b descends in the magazine 4 and urges the freshly exposed or unpacked batch 21 against the biasing member 9a therebelow. Such downward movement of the member 9b takes place when the tip of the member 9a reaches and actuates the lower limit switch 12b. In the next step, the motor 10*a* retracts the biasing member 9*a* from the magazine 4 and the motor 10 moves the retracted member 9*a* upwardly to a level above the member 9*b*. The motor 10*a* is actuated again to reintroduce the member 9*a* into the magazine 4 and the motor 10 moves the member 9*a* downwardly into compacting engagement with the replenished supply of bristles in the magazine 4. As shown in FIG. 3, the members 9*a* and 9*b* can readily bypass each other.

In the next step, the motor 10*b*′ retracts the biasing member 9*b* from the magazine 4 (preferably with a delay which suffices to enable the member 9*a* to move the uppermost layer of bristles to a level below the needles 27 of the member 9*b*), the motor 10′ moves the member 9*b* upwardly, and the lower gate 26 is retracted to allow the lowermost bundle 21 in the hopper 20 to descend onto the biasing member 9*a*. The lower gate 26 then returns to the extended position, the upper gate 26 is retracted to allow a bundle 21 to descend onto the lower gate, and the upper gate returns to the position of FIG. 4 so that the lowermost bundle 21 is confined between the two gates. In the next step, the motor 10*b*′ returns the biasing member 9*b* into the magazine 4 and the motor 10′ moves the member 9*b* downwardly so that the needles 27 engage the envelope 23 of the bundle 21 on the member 9*a*. The upper gate 26 can be moved to extended position, simultaneously with movement of the lower gate 26 to retracted position, in response to a signal which is furnished when the biasing member 9*a* engages and actuates the upper limit switch 12*a*.

The knife 24 is thereupon caused to move across the interior of the magazine 4 and to open the envelope 23 of the bundle 21 on the biasing member 9*a*. The opened envelope 23 is engaged (and preferably lifted) by the member 9*b* prior to being expelled or evacuated from the upper portion of the magazine 4 below the singularizing unit 25, either in response to leftward movement of the member 9*b*, in response to discharge of compressed fluid (e.g., air) from the aforementioned nozzle or nozzles, or by the biasing member 9*b* with assistance from the jets of fluid.

An advantage of the apparatus 1b is that it requires even less attention than the apparatus 1a. Thus, if the hopper 20 is sufficiently large to accept a substantial number of bundles 21, the apparatus 1*b* can properly compact and feed bristles 2 for a long interval of time. Moreover, the supply of bundles 21 in the hopper 20 can be replenished at any time, i.e., regardless of whether the upper gate 26 is held in the retracted or extended position and regardless of the position of the biasing member 9*a* and/or 9*b*. Automatic opening of envelopes 23 reduces the likelihood of injury to attendants and enables one and the same attendant to service an even larger number of brush making machines. As explained hereinbefore, insertion of fresh batches of bristles into the feeding apparatus in accordance with heretofore known procedures invariably requires at least some skill and carefulness. On the other hand, feeding of bundles 21 into the hopper 20 can be entrusted to persons having little or no skill. The height of the column of bundles 21 in the hopper 20 does not influence the compacting action of biasing members 9*a* and 9*b* because such biasing members are shielded from the weight of the column in the hopper by the gates 26.

The details of means for moving the knife 24 are shown in FIGS. 5 and 6. The knife 24 is mounted on the piston rod of a fluid-operated motor 28 and is movable in and counter to the direction indicated by arrow P*f*2. The right-hand end portion 29 of the knife 24 (i.e., that end portion which is remote from the motor 28) has a suitably curved cutting edge 30 which severs the adjacent envelope 23 while the knife moves in the direction indicated by the arrow P*f*2. The knife 24 thereupon returns to the illustrated position in which the edge 30 is located outside of the magazine 4. The prongs 19 of the bearing member 9b press the envelope 23 against the knife 24 while the cutting edge 30 performs a severing action. This insures that the edge 30 slits the envelope 23 from end to end.

FIGS. 7 to 9 illustrate a modified severing unit 22*a* whose knife 24 remains in the interior of the magazine 4 upon completion of the severing step. The envelopes 23 are opened from below and the contents (bristles 2) of an opened envelope form two streams which travel downwardly at the opposite sides of the knife 24 under the pressure which is applied by the biasing member 9*b*.

A knife which can be used in the severing unit 22*a* of FIGS. 7–9 is shown in FIG. 10. This knife resembles a saw blade and its teeth face upwardly. By using a knife of such type, one can reduce the length of the stroke of the motor which serves to move the knife relative to the adjacent envelope 23. The extent of displacement of the knife 24 need not exceed the distance between the deepmost portions of two neighboring tooth spaces. In fact, and especially if the envelope 23 which surrounds a bundle 21 of bristles 2 is sufficiently taut, the knife of FIG. 10 can sever the envelope without any movement relative to the descending bundle 21; the tips of its teeth simply form a row of perforations in the envelope which is biased by the member 9*b* whereby the envelope bursts open in response to the pressure of confined bristles.

Figure 11:
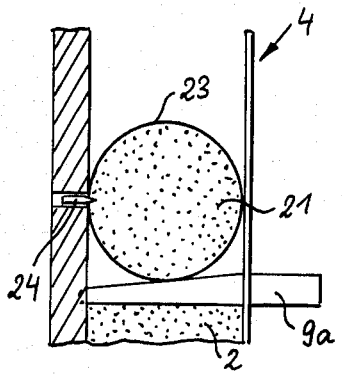
FIG. 11 shows a further opening device.

FIG. 11 shows that the knife 24 can be mounted in a horizontal slot of one side wall of the magazine 4 so that it severs the descending envelope 23 at the nine o'clock position. The knife of FIG. 11 may but need not be coupled to a motor, depending upon whether it is configurated in a manner as shown in FIG. 6 or FIG. 10. This knife can be mounted for movement lengthwise of the envelope or radially toward the center of the bundle 21.

Figure 12:
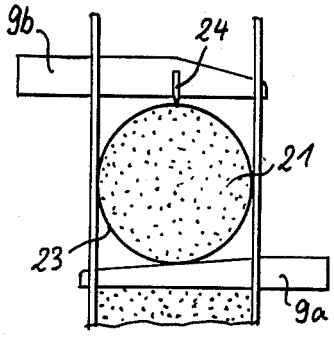
FIG. 12 illustrates still another opening device.

It is further possible to locate the knife 24 at a level above the envelope 23 which rests on the biasing member 9*a*. Such knife can be mounted in the magazine 4, on a part which is adjacent to or supported by the magazine, or directly on the biasing member 9b (see FIG. 12).

Figure 13:
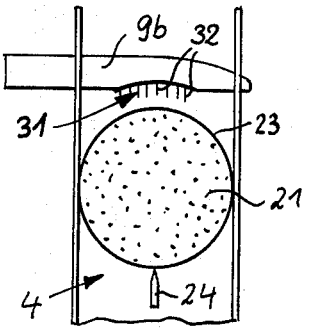
FIG. 13 illustrates an envelope evacuating device which is similar to that used in the apparatus of FIG. 4.

Several embodiments of removing or evacuating means for opened envelopes 23 are shown in FIGS. 13 to 18. The evacuating means 31 of FIG. 13 is practically identical with the evacuating means of FIG. 4. It comprises one or more rows of parallel needles or analogous projections 32 which are provided at the underside of the biasing member 9b and are sufficiently sharp to penetrate into the material of the envelope 23 therebelow. In this embodiment, the knife 24 is located below the bundle 21 whose envelope is about to be opened. The prongs of the biasing member 9b have concave undersides so as to insure that the tips of the needles 32 extend along an arc whose curvature matches or approximates that of the adjacent portion of the envelope 23.

Figure 14:
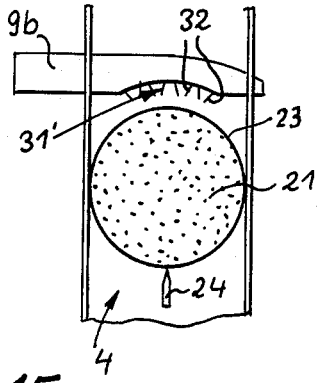
FIG. 14 illustrates a second evacuating device.

The evacuating means 31′ of FIG. 14 is similar to the evacuating means 31 except that the needles 32 are not parallel to each other. Such orientation of needles 32 is even more likely to insure that the opened envelope 23 will adhere to the biasing member 9b upon completion of the severing step. The knife 24 is mounted in the same way as the knife of FIG. 13.

Figure 15:
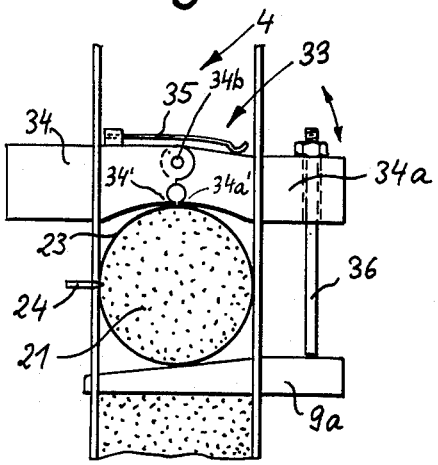
FIG. 15 shows a third evacuating device.

FIG. 15 shows evacuating or removing means 33 which comprises two clamping elements or jaws 34 and 34*a* articulately connected to each other by a horizontal pintle 34*b* and having pinching edges 34', 34*a'* which are adjacent to the envelope 23 therebelow. A leaf spring 35 which is mounted on the jaw 34 biases the jaw 34*a* in a clockwise direction to normally maintain the edge 34*a'* close to the edge 34'. A preferably adjustable stud 36 is secured to the jaw 34a and can engage the biasing member 9a whereby the jaw 34*a* is pivoted anticlockwise, as viewed in FIG. 15, and moves the edge 34*a'* away from the edge 34'. As the member 9*a* continues to descend, the jaw 34*a* pivots clockwise and the adjacent portion of the envelope 23 (which has been opened by the knife 24) is pinched between the edges 34', 34*a'*. The evacuating means 33 may be moved into and out of the magazine 4 by a suitable motor (not shown), e.g., by a motor analogous to the motor 28 of FIG. 6.

The stud 36 need not engage the biasing member 9a. Thus, the evacuating means 33 may include an electromagnet or the like which pivots the jaw 34*a* counterclockwise while the jaw 34 continues to contact the opened envelope 23, whereupon the spring 35 is allowed to pivot the jaw 34 clockwise and to cause the edges 34', 34*a'* to pinch a portion of the opened envelope so that the latter can be withdrawn with the evacuating means 33. The magazine 4 is then free to receive a fresh bundle 21.

Figure 16:
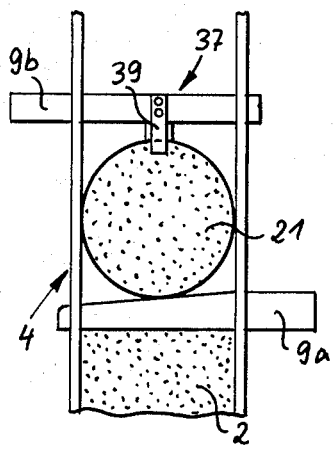
FIG. 16 is an end elevational view of a fourth evacuating device.
Figure 17:
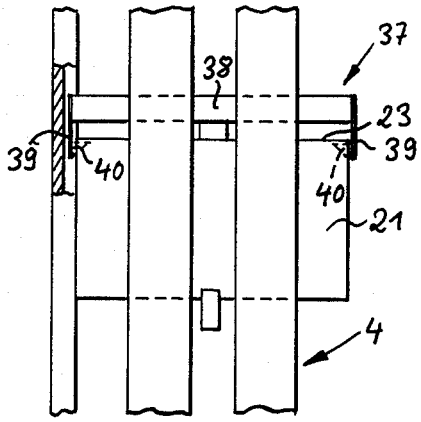
FIG. 17 is a side elevational view of the structure shown in FIG. 16.
Figure 18:
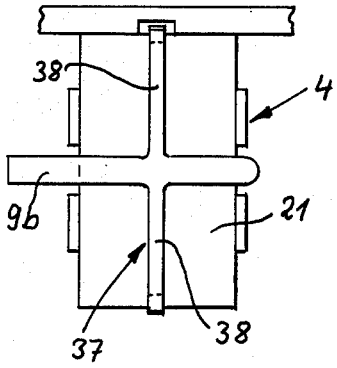
FIG. 18 is a plan view of the structure shown in FIG. 16.

The evacuating or removing means 37 of FIGS. 16 to 18 is mount4ed entirely on the biasing member 9*b*. It comprises two elongated carriers 38 which extend transversely of the biasing member 9*b* (see FIG. 18) and whose end portions are provided with downwardly extending leaf springs 39 having inwardly extending grippers or teeth 40 which engage the inner side of the envelope 23 when the latter is pushed downwardly by the biasing member 9*b*. The springs 39 enable the teeth 40 to move apart while the biasing member 9*b* moves downwardly toward the envelope 23, and the tips of the teeth 40 then enter the adjacent bundle 21 to insure that the envelope will be lifted with the member 9*b* as soon as the knife (not shown) completes its working stroke or otherwise opens the envelope. The normal distance between the teeth 40 is slightly less than the axial length of a bundle 21, and the carriers 38 extend in parallelism with the axis of a bundle 21 which is properly received in the magazine 4.

It is further within the purview of the invention to use evacuating means which employs one or more suction cups, adhesive pads or analogous devices which attract the envelope and can remove the envelope from the magazine as soon as the opening step is completed. Moreover, the evacuating means may employ a combination of two or more different features, e.g., the needles 27 of FIG. 4 and one or more suction cups.

In each embodiment of the improved apparatus, the magazine 4 can be equipped or provided with one or more vibrators or shakers which promote orderly descent of bristles 2 and reduce the likelihood that the bristles would lie askew. Vibrators are especially desirable in the apparatus of FIG. 4 in order to insure satisfactory orientation of bristles 2 which are released in response to opening of an envelope 23 at the station 22 and subsequent upward movement of the biasing member 9*b* (together with the opened envelope).

Figure 19:
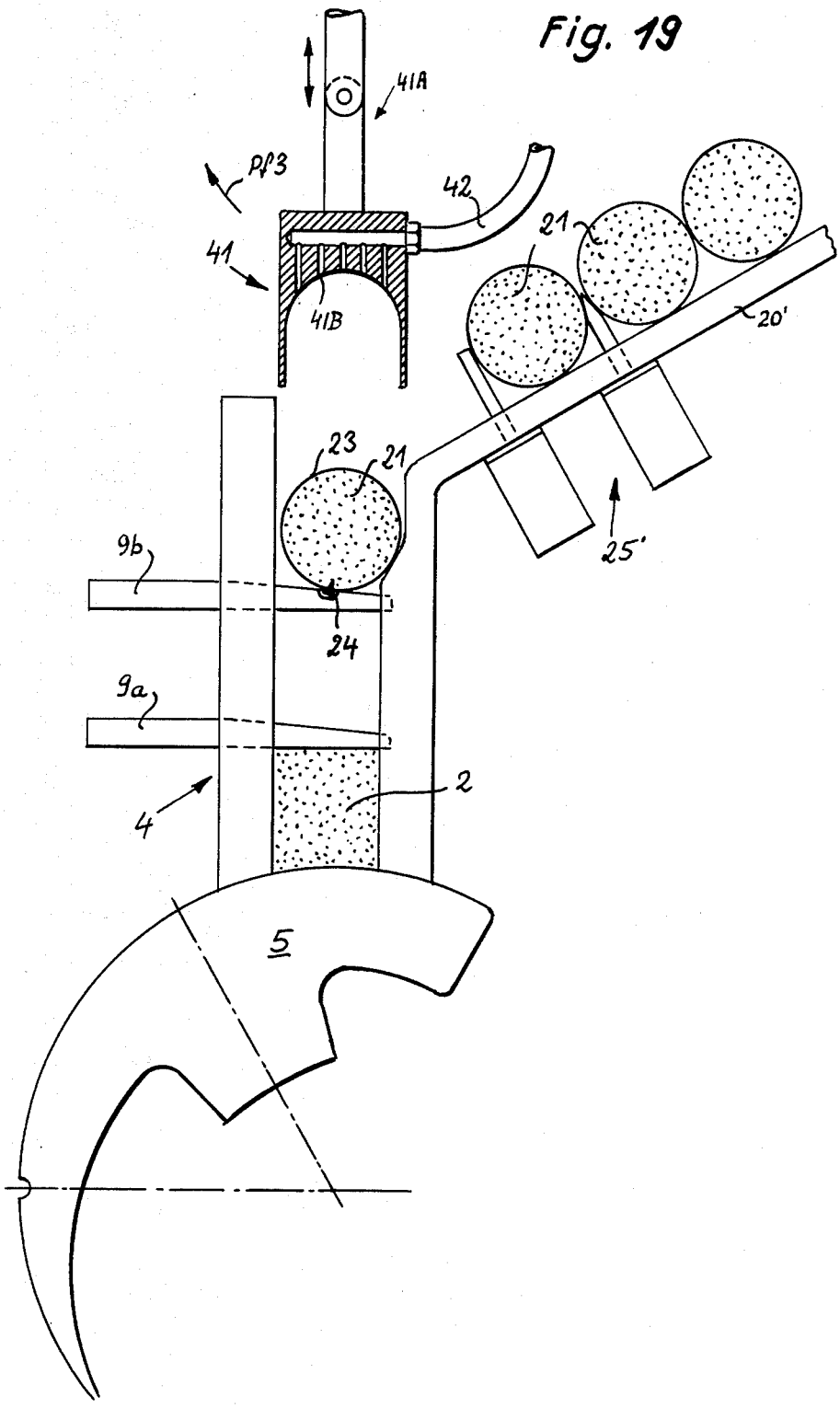
FIG. 19 is a fragmentary partly elevational and partly sectional view of a brush making machine which embodies a fourth bristle feeding apparatus having a suction-operated envelope evacuating device.

One form of evacuating or removing means which utilizes one or more suction-operated components is shown in FIG. 19. Such evacuating means can be used with advantage when the external surfaces of the envelopes 23 are smooth, e.g., if such envelopes consist of synthetic plastic material. The suction head 41 of FIG. 19 is movable up and down with a motion transmitting device 41A and is also pivotable in and counter to the direction indicated by arrow Pf3. The slots or ports 41B in the concave internal surface of the suction head 41 are connected to a suction generating device (e.g., a fan, not shown) by a flexible conduit 42. The configuration of the concave surface of the suction head 41 is such that the surface can lie flush against a substantial portion of the external surface of the envelope 23 which rests on the biasing member 9*b*. The latter carries a knife 24 whose cutting edge faces upardly so that the envelope 23 is or can be split open in response to gravitational descent of the respective bundle 21 into the magazine 4.

When a freshly admitted bundle 21 comes to rest on the biasing member 9*b*, the suction head 41 descends and its concave surface engages and attracts the envelope 23. If the latter is still intact or is only partially open, the knife 24 is caused to perform a working stroke so as to open the envelope 23 before the suction head 41 begins to rise back to the position shown in FIG. 19. In the next step, the suction head 41 is pivoted clockwise (arrow P*f*3) and its ports 41B are disconnected from the suction generating device whereby the opened envelope descends by gravity, e.g., into an intercepting receptacle (not shown). The suction head 41 is thereupon returned to the angular position shown in FIG. 19, i.e., above the magazine 4. If desired, the ports 41B can be temporarily connected with a source of compressed air or another fluid in automatic response to pivoting of the suction head 41 in the direction indicated by arrow P*f*3 so that the opened envelope 23 is expelled from the recess in the underside of the suction head.

The hopper 20 of FIG. 4 is replaced with a magazine including a suitably inclined ramp 20' which feeds successive bundles 21 into the magazine 4, i.e., onto the biasing member 9*b*. The function of the singularizing unit 25' is the same as that of the unit 25 shown in FIG. 4.

The aforementioned evacuating or removing means which employ adhesive pads or the like can be used with advantage for removal of certain types of envelopes, e.g., envelopes consisting of crepe paper. Such evacuating means may comprise a ram which replaces the suction head 41 of FIG. 19 and carries one or more adhesive-coated strips or pads which adhere to the envelope on the biasing member 9*b* when the ram descends into the magazine 4. The ram is thereupon lifted with the attracted (opened) envelope and is moved past a suitable stripper which separates the envelope from the adhesive strip or strips. The just described removing means is clearly analogous to the removing means of FIG. 19 since both attract opened envelopes (by suction or by means of an adhesive) during evacuation from the magazine.

Figure 20:
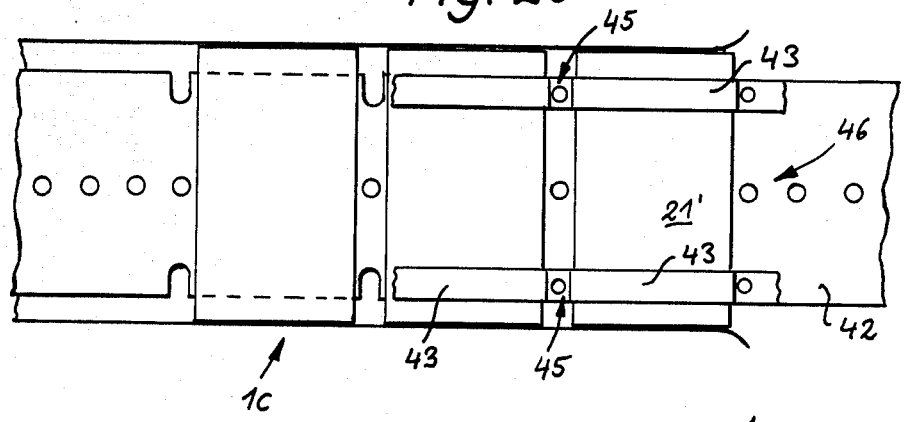
FIG. 20 is a fragmentary plan view of a series of coherent packaged batches of bristles which can be admitted into the improved bristle feeding apparatus.
Figure 21:
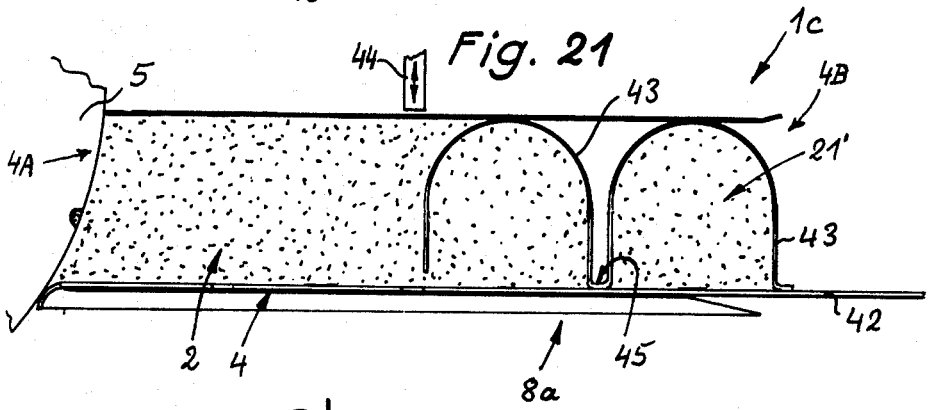
FIG. 21 is a fragmentary side elevational view of a brush making machine embodying an apparatus which can process coherent batches of bristles of the type shown in FIG. 20.

FIGS. 20 and 21 illustrate a further apparatus 1*c* which constitutes a modification of the apparatus 1b of FIG. 4. The bundles 21' form an elongated row and extend transversely of a flexible supporting web or carrier 42. The envelopes of the bundles 21' consist of pairs of U-shaped strips 43 which are adjacent to the respective marginal portions of the supporting web 42 and are secured thereto, as at 45. If the material of the web 42 and strips 43 is a synthetic thermoplastic substance, the strips 43 can be bonded (welded) to the web in response to the application of heat and pressure. The spaces between neighboring bundles 21' are sufficiently wide to allow for entry of a knife 44 or an analogous severing device which severs the joints 45 and preferably also removes the adjacent portions of strips 43 and web 42. Each of the two rows of strips 43 may constitute a continuous band of flexible synthetic plastic material which forms a series of loops surrounding the bristles 2 of the respective bundles 21'. The knife 44 may constitute a pinch which removes successive pairs of transversely aligned joints 45 during successive intervals of dwell of the web 42. The latter is provided with one or more rows of perforations 46 which can receive pin-shaped or tooth-shaped entraining portions or projections 48 of an advancing device 47 (see FIG. 22) serving to feed the web 42 and successive batches or bundles 21' into the magazine 4. In this apparatus, the unopened batches or bundles 21' constitute a pressure applying device 8*a* which replaces the aforedescribed tamping or biasing member or members by applying pressure against unconfined bristles 2 in the interior of the magazine 4 so that the leader of the column of bristles in the magazine bears against the convex surface of the oscillating or rotating transfer element 5. It can also be said that the web 42 constitutes or forms part of the pressure applying device 8*a*.

It is clear that the arcuate portions of strips 43 can be evacuated by means other than the severing device 44, e.g., by resorting to suction cups, adhesive coated pads, needles or other evacuating elements. The leader of the web 42 can be caused to pass between the convex surface of the transfer element 5 and the discharge end of the magaizine 4 to be collected on a reel or the like, not shown, or to be discharged into a collecting receptacle.

Figure 22:
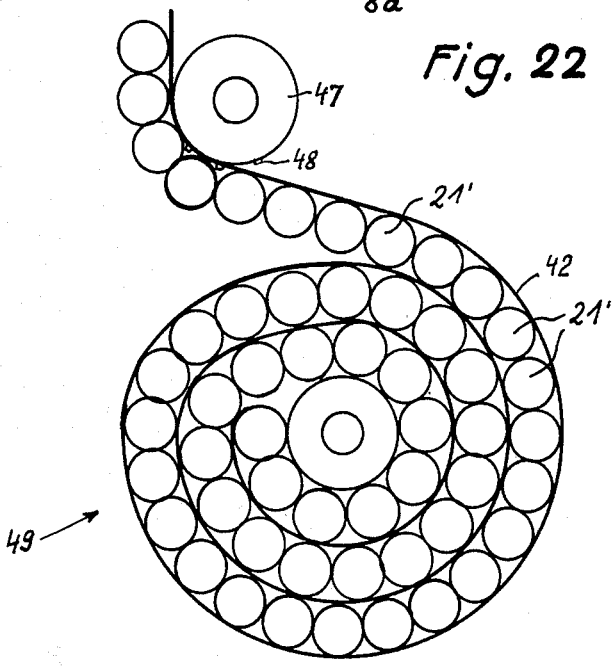
FIG. 22 is schematic side elevational view of a roll of coherent batches of bristles which can be supplied to the apparatus of FIG. 21.

An advantage of the apparatus 1*c* is that the supply of loose (unconfined) bristles 2 can be stored in a horizontal or substantially horizontal magazine. This is due to the fact that the bundles 21' need not be fed by gravity. The web 42 can be coiled in a manner as shown in FIG. 22 to form a large source in the form of a roll or chain 49 containing a substantial number of bundles 21' such as will suffice to meet the requirements of a high-speed fully automatic brush making machine for very long intervals of time. This renders it possible to further reduce the number of attendants and to employ unskilled or semiskilled personnel. The advancing means 47 (e.g., a sprocket wheel or other suitable means for moving the web 42 lengthwise) can be placed sufficiently close to the inlet of the magazine 4 to insure that the web will not buckle in the space between the advancing means and the magazine. This also insures that the foremost unopened bundles 21' can perform the function of pressure applying means (8*a*) for loose bristles 2 in the interior of the magazine 4.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. In a brush making machine, the combination of a magazine arranged to store a supply of substantially parallel bristles and having an inlet and an outlet; a source of bristles including a succession of bundles each having a batch of parallel bristles and an envelope for the respective batch, and carrier means supporting said bundles; means for advancing successive bundles into said magazine by way of said inlet; means for opening the envelopes of successive bundles so that the respective batches are unconfined; means for applying pressure to unconfined batches of bristles in said magazine in a direction toward said outlet; and means for transferring tufts of compacted bristles from said magazine by way of said outlet.

2. The combination of claim 1, wherein said pressure applying means includes the foremost bundle whose envelope is still intact.

3. The combination of claim 1, wherein said pressure applying means includes said carrier.

4. The combination of claim 1, wherein said carrier in a web consisting of synthetic plastic material and each of said envelopes includes at least one strip which is looped around the respective batch and whose ends are bonded to said web.

5. The combination of claim 1, wherein the neighboring bundles of said source are spaced apart from each other.

6. The combination of claim 1, wherein said carrier has a longitudinally extending row of perforations and said advancing means includes a rotary member having projections which enter successive perforations of said carrier.

7. The combination of claim 1, wherein the bundles of said succession form a roll.

8. A method of feeding tufts of bristles to the inserting station of a brush making machine, comprising the steps of establishing and maintaining a supply of substantially parallel bristles at said station; subjecting the bristles of said supply to the action of a first compacting force; removing tufts of bristles from the compacted supply; establishing and maintaining an accumulation of additional bristles which constitute batches each consisting of parallel bristles and each confined in an envelope; transporting said batches seriatim to said supply; merging the bristles of successively transported batches into the diminishing supply while continuing to subject the bristles of said diminishing supply to the action of said force, including subjecting the bristles of successive batches to the action of a second compacting force which at least approximates said first force so that the compactness of the thus replenished supply remains at least substantially unchanged; and removing the envelopes from successive batches not later than in the course of said merging step.

9. A method as defined in claim 8, wherein said steps of subjecting said supply and said additional bristles to the action of said compacting forces include pressing the batches against the bristles of said supply.

10. A method as defined in claim 8, further comprising the step of opening said envelopes prior to said removing step.

11. A method as defined in claim 8, wherein said steps of subjecting the bristles to the action of said forces include mechanically biasing the bristles of said supply and said additional bristles.

12. A method as defined in claim 8, wherein said removing step includes removing tufts from the bottom of said supply and said merging step further includes feeding additional bristles on top of the diminishing supply.

13. A method as defined in claim 8, further comprising the step of confining said supply in a substantially horizontal path wherein said supply has a leading end and a trailing end, said removing step including removing tufts from said leading end and said merging step further including feeding additional bristles to the trailing end of said supply.

14. A method of feeding tufts of bristles to the inserting station of a brush making machine, comprising the steps of establishing and maintaining a supply of substantially parallel bristles at said station; subjecting the bristles of said supply to the action of a first compacting force; removing tufts of bristles from the compacted supply; monitoring the number of removed tufts; and merging additional bristles into the diminishing supply in automatic response to removal of a predetermined number of tufts while continuing to subject the bristles of said diminishing supply to the action of said force, including subjecting the additional bristles to the action of a second compacting force which at least approximates the first force so that the compactness of the thus replenished supply remains at least substantially unchanged.

15. In a brush making machine, the combination of a magazine arranged to store a supply of substantially parallel bristles and having an outlet; means for applying pressure to bristles in said magazine including a plurality of biasing members including a first and a second member, and means for repeatedly moving said members away from and toward said outlet whereby said members compact the bristles during movement toward said outlet, said moving means including means for moving one of said members out of compressive engagement with the bristles in said magazine while the other of said members urges the bristles in said magazine toward said outlet, and vice versa; means for admitting additional bristles into said magazine behind the compacted supply, said additional bristles being admitted in the form of bundles each of which includes a batch of bristles and an envelope confining the respective batch; means for removing the envelopes of successive bundles not later than on admission of the respective bundles into said magazine; and means for transferring tufts of compacted bristles from said magazine by way of said outlet.

16. The combination of claim 15, wherein said removing means includes means for mechanically engaging the envelopes of successive bundles.

17. The combination of claim 15, wherein said envelopes are admitted into said magazine with the respective batches and said removing means includes means for attracting the envelopes and means for moving the attracting means into and from said magazine.

18. The combination of claim 17, wherein said attracting means includes at least one suction-operated device.

19. The combination of claim 15, wherein said envelopes are admitted into said magazine with the respective batches and further comprising means for opening the envelopes prior to removal of such envelopes from said magazine.

20. The combination of claim 19, wherein said opening means includes a knife and means for moving said knife into and from said magazine so that said knife engages and severs an envelope while moving into and in said magazine.

21. The combination of claim 19, wherein said opening means includes a knife secured to one of said biasing members.

22. The combination of claim 19, further comprising a second magazine for a supply of bundles and singularizing means for admitting individual bundles into the range of said opening means and said removing means.

23. The combination of claim 22, wherein said singularizing means comprises a plurality of gates movable into and out of one of said magazines and means for moving one of said gates out of the corresponding magazine while the other gate extends into the corresponding magazine and vice versa.

24. The combination of claim 22, wherein said opening means includes a knife arranged to sever the envelopes of successive bundles.

25. The combination of claim 24, wherein each of said envelopes is a tube and said opening means further comprises means for moving said knife lengthwise of the adjacent tube.

26. The combination of claim 24, wherein said envelopes are elongated tubes and said knife has a row of teeth extending substantially along the full length of the adjacent tube.

27. The combination of claim 22, wherein said second magazine is disposed above said first mentioned magazine and said opening means includes a knife located below the envelope of the lowermost bundle of bristles in said second magazine.

28. In a brush making machine, the combination of a magazine arranged to store a supply of substantially parallel bristles and having an inlet and an outlet, said outlet being located at a level below said inlet; means for intermittently transferring tufts of bristles from said magazine by way of said outlet; means for applying pressure to bristles in said magazine including a first and a second biasing member and means for cyclically moving said members in said magazine toward said outlet whereby said members compact the bristles during such movement, said moving means including means for moving said first member out of compressive engagement with the bristles while said second member urges the bristles in said magazine toward said outlet and vice versa so that the bristles at said outlet are subjected to a continuous and at least substantially constant compacting force during each transfer of tufts as well as during the intervals between successive transfers, said last mentioned moving means including at least one motor for each of said biasing members and said motors being arranged to move the respective biasing members up and down; and means for admitting additional bristles into said magazine behind the compacted supply via said inlet.

29. The combination of claim 28, wherein said motor means includes means for moving at least one of said biasing members cyclically out of the magazine, thereupon away from said outlet, then back into the magazine and thereupon toward said outlet, and the admission of additional bristles via said inlet takes place while said one biasing member is located outside of said magazine.

30. The combination of claim 28, wherein said biasing members extend transversely of the bristles in said magazine.

31. In a brush making machine, the combination of a magazine arranged to store a supply of substantially parallel bristles and having an outlet; means for intermittently transferring tufts of bristles from said magazine by way of said outlet; means for applying pressure to bristles in said magazine including a first and a second biasing member and means for cyclically moving said members in said magazine toward said outlet whereby said members compact the bristles during such movement, said biasing members including bristle-engaging portions which are offset with respect to each other so that each of said members can bypass the other member in the interior of said magazine and said moving means including means for moving said first member out of compressive engagement with the bristles while said second member urges the bristles in said magazine toward said outlet and vice versa so that the bristles at said outlet are subjected to a continuous and at least substantially constant compacting force during each transfer of tufts as well as during the intervals between successive transfers; and means for admitting additional bristles into said magazine behind the compacted supply.

32. The combination of claim 31, wherein the bristle-engaging portion of one of said biasing members is slotted and the bristle-engaging portion of the other of said members registers with the slot of said slotted portion.

33. The combination of claim 32, wherein said moving means includes at least one motor for each of said biasing members, said motors having means for moving the respective biasing members in said magazine toward and away from said outlet.

34. The combination of claim 33, further comprising means for pivotally connecting one of said biasing members to the respective motor.

35. The combination of claim 34, wherein said moving means comprises at least one fluid-operated motor for each of sid biasing members.

36. In a brush making machine, the combination of a magazine arranged to store a supply of substantially parallel bristles and having an outlet; means for intermittently tranferring tufts of bristles from said magazine by way of said outlet; means for applying pressure to bristles in said magazine including a first and a second biasing member and means for cyclically moving said members in said magazine toward said outlet whereby said members compact the bristles during such movement, said moving means including means for moving said first member out of compressive engagement with the bristles while said second member urges the bristles in said magazine toward said outlet and vice versa so that the bristles at said outlet are subjected to a continuous and at least substantially constant compacting force during each transfer of tufts as well as during the intervals between successive transfers; means for admitting additional bristles into said magazine behind the compacted supply; and means for monitoring the supply of bristles in said magazine and for actuating said moving means in accordance with a predetermined program.

37. The combination of claim 36, wherein said monitoring means comprises at least one limit switch actuatable by one of said biasing members.

38. In a brush making machine, the combination of a magazine arranged to store a supply of substantially parallel bristles and having an outlet; means for intermittently transferring tufts of bristles from said magazine by way of said outlet; means for applying pressure to bristles in said magazine including a first and a second biasing member and means for cyclically moving said members in said magazine toward said outlet whereby said members compact the bristles during such movement, said moving means including means for moving said first member out of compressive engagement with the bristles while said second member urges the bristles in said magazine toward said outlet and vice versa so that the bristles at said outlet are subjected to a continuous and at least substantially constant compacting force during each transfer of tufts as well as during the intervals between successive transfers, said last mentioned moving means comprising at least one motor for each of said biasing members, means for pivotally connecting one of said biasing members to the respective motor for movement between first and second positions in which saidone biasing member respectively extends across the bristles in said magazine and is located outside of said magazine, and means for yieldably urging said one member to said first position, said one member being moved to said second position while the respective motor is operated to move said one member away from said outlet; and means for admitting additional bristles into said magazine behind the compacted supply.

* * * * *

UNITED STATES PATENT AND TRADEMARK OFFICE

CERTIFICATE OF CORRECTION

PATENT NO. : 4,111,491

DATED : September 5, 1978

INVENTOR(S) : Walter Steinebrunner, Arthur Zahoransky and Heinz Zahoransky

It is certified that error appears in the above-identified patent and that said Letters Patent are hereby corrected as shown below:

In the ABSTRACT, line 2, "bursh making" should read --brush making--;

Col. 1, line 9,"groups of tufts" should read --groups tufts--;

Col. 1, line 30, "attandant" should read --attendant--;

Col. 3, line 37, "one for of the" should read --one form of the--;

Col. 4, line 16, "is schematic side" should read --is a schematic side--;

Col. 4, line 54, "direction" should read --directions--;

Col. 5, line 44, "the signnal which" should read --the signal which--;

Col. 11, line 33, "mount4ed" should read --mounted--;

Col. 12, line 17, "upardly" should read --upwardly--;

Col. 13, line 12, "pinch" should read --punch--;

Col. 13, line 36, "magaizine" should read --magazine--;

Col. 14, lines 20-21, "in a web" should read --is a web--; and

Col. 17, line 35, "sid" should be --said--.

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*